US011565923B2

(12) United States Patent
Okroy et al.

(10) Patent No.: US 11,565,923 B2
(45) Date of Patent: Jan. 31, 2023

(54) CHAIN SLACK DETECTION SYSTEM

(71) Applicant: Crown Equipment Corporation, New Bremen, OH (US)

(72) Inventors: Martin Okroy, Munich (DE); Masoud Karimi, Munich (DE)

(73) Assignee: Crown Equipment Corporation, New Bremen, OH (US)

( * ) Notice: Subject to any disclaimer, the term of this patent is extended or adjusted under 35 U.S.C. 154(b) by 873 days.

(21) Appl. No.: 16/279,408

(22) Filed: Feb. 19, 2019

(65) Prior Publication Data

US 2020/0262690 A1 Aug. 20, 2020

(51) Int. Cl.

| | |
|---|---|
| ***B66F 9/22*** | (2006.01) |
| ***B66F 9/075*** | (2006.01) |
| ***B66F 9/08*** | (2006.01) |
| ***B66F 17/00*** | (2006.01) |

(52) U.S. Cl.

CPC ..... *B66F 9/22* (2013.01); *B66F 9/0755* (2013.01); *B66F 9/08* (2013.01); *B66F 17/003* (2013.01)

(58) Field of Classification Search

CPC .. B66F 9/22; B66F 9/0755; B66F 9/08; B66F 17/003

See application file for complete search history.

(56) References Cited

U.S. PATENT DOCUMENTS

| | | | |
|---|---|---|---|
| 3,224,529 | A | 12/1965 | Gandolfo |
| 3,416,109 | A | 12/1968 | Gandolfo et al. |
| 4,015,686 | A | 4/1977 | Bushnell, Jr. |
| 4,111,283 | A | 9/1978 | Hastings, Jr. |
| 4,212,360 | A | 7/1980 | Chesher |
| 4,305,513 | A | 12/1981 | Voelz |
| 4,499,971 | A | 2/1985 | Luebrecht et al. |
| 4,762,203 | A | 8/1988 | Ryan |

(Continued)

FOREIGN PATENT DOCUMENTS

| | | | |
|---|---|---|---|
| CN | 102583202 | B | 1/2014 |
| DE | 3106226 | A1 | 9/1982 |

(Continued)

OTHER PUBLICATIONS

"Conveying & Materials Handling"; Dec. 2016; Feed & Grain.

(Continued)

*Primary Examiner* — Tyler J Lee
*Assistant Examiner* — Yufeng Zhang
(74) *Attorney, Agent, or Firm* — Stevens & Showalter LLP

(57) ABSTRACT

A materials handling vehicle includes a mast, a load handling structure supported on the mast, one or more operator controls, and a lifting structure having a chain structure for performing a lifting and lowering of the load handling structure. The materials handling vehicle further includes a height sensor for generating a height signal corresponding to vertical movement of the load handling structure relative to the mast, and a vehicle control module for processing the height signal received from the height sensor and an operator control signal received from the one or more operator controls. The vehicle control module evaluates the height signal and the operator control signal and disables one or more vehicle functions if the height signal does not correspond to the operator control signal.

17 Claims, 5 Drawing Sheets

(56) References Cited

U.S. PATENT DOCUMENTS

| | | | | | |
|---|---|---|---|---|---|
| 4,782,920 | A * | 11/1988 | Gaibler | B66F 9/0755 187/224 |
| 5,379,594 | A | 1/1995 | Quellhorst | |
| 5,395,209 | A | 3/1995 | Busse et al. | |
| 5,462,136 | A * | 10/1995 | Schoenmaker | B66F 17/003 187/223 |
| 5,657,834 | A | 8/1997 | Plaugher et al. | |
| 5,824,963 | A | 10/1998 | Bruns et al. | |
| 5,984,050 | A | 11/1999 | Ronald | |
| 6,287,236 | B1 * | 9/2001 | Ishikawa | F16H 63/483 477/71 |
| 6,533,076 | B1 | 3/2003 | Haverfield et al. | |
| 7,140,486 | B2 | 11/2006 | Kim | |
| 7,240,771 | B2 | 7/2007 | Perkins | |
| 7,344,000 | B2 | 3/2008 | Dammeyer et al. | |
| 7,544,037 | B2 | 6/2009 | Haverfield et al. | |
| 8,840,159 | B2 | 9/2014 | Karlsson | |
| 8,985,275 | B2 | 3/2015 | Solhjem et al. | |
| 2004/0045745 | A1 | 3/2004 | Schiebel et al. | |
| 2013/0248297 | A1 | 9/2013 | Manes et al. | |
| 2015/0122585 | A1 | 5/2015 | Berns et al. | |

FOREIGN PATENT DOCUMENTS

| | | | |
|---|---|---|---|
| EP | 0277782 | A2 | 8/1988 |
| JP | H01176700 | U | 12/1989 |
| JP | 6321314 | A | 11/1994 |
| JP | 2001220094 | A | 8/2001 |
| JP | 2003238091 | A | 8/2003 |
| KR | 20100002555 | A | 1/2010 |

OTHER PUBLICATIONS

Colletti, Roberta; International Search Report and Written Opinion; International Application No. PCT/US2019/055552, dated Mar. 18, 2020; European Patent Office; Rijswijk, Netherlands.

International Preliminary Report on Patentability and Written Opinion of the International Searching Authority dated Aug. 10, 2021; International Application No. PCT/US2019/055552; The International Bureau of WIPO; Geneva, Switzerland.

Notification of the First Office Action dated Jun. 22, 2022; Chinese Application No. 201980090057.6; China National Intellectual Property Administration; Beijing, China.

First Search dated Jun. 15, 2022; Chinese Application No. 201980090057.6; China National Intellectual Property Administration; Beijing, China.

Notification of the Second Office Action dated Nov. 11, 2022; Chinese Application No. 201980090057.6; China National Intellectual Property Administration; Beijing, China.

* cited by examiner

CHAIN SLACK DETECTION SYSTEM

FIELD OF THE INVENTION

The present invention relates to materials handling vehicles, and more particularly, to chain slack detection in materials handling vehicles.

BACKGROUND OF THE INVENTION

Many types of materials handling vehicles, such as fork-lift trucks, have been developed wherein material handling devices, typically forks, are elevated to extreme heights to store and retrieve materials at upper levels within a warehouse. Such high lift vehicles commonly use a variety of mast arrangements wherein the forks, and oftentimes also the operator of the vehicle, are elevated high above the floor of the warehouse to perform picking and/or storage operations. In a typical multi-stage mast construction, a movable carriage comprising forks is supported for vertical movement relative to at least one mast section by a chain, where a first end of the chain is attached to the movable carriage and a second end of the chain is anchored to a relatively stationary location. An actuating member includes a vertically movable element, such as the ram of a cylinder assembly, acting on a midsection of the chain, between the first and second ends, to tension the chain and cause the movable carriage to move upward, wherein a controlled tension is maintained on the chain during a downward actuation of the actuating member to lower the movable carriage.

During a typical materials handling vehicle operation, the vehicle is operated to position the movable carriage via horizontal as well as vertical movement. As a result of horizontal movement of the movable carriage toward shelving or a rack for storing products, the forks may be positioned in an overlapping relationship over a shelf or rack. If the movable carriage is then actuated vertically in downward movement, the forks may engage and become caught on the shelf or rack, causing the chain to become slack between the first and second chain ends as the actuating member continues the downward movement. Subsequently, horizontal movement of the movable carriage, moving the forks out of engagement with the shelf or rack could result in the movable carriage dropping or free-falling until chain tension is re-established.

In a known system for detecting chain slack, a compression spring is located at a chain anchor/tensioner for biasing the end of a lift chain relative to a switch. When a chain slack event occurs during a lowering operation, the compression spring pushes the chain anchor/tensioner, and the switch can detect this movement and send a signal to stop the lowering operation. This type of chain slack detection system and similar systems typically require additional hardware with associated expense for implementation.

BRIEF SUMMARY OF THE INVENTION

In accordance with an aspect of the invention, a materials handling vehicle is provided having chain slack detection. The materials handling vehicle comprises a mast assembly, a load handling structure supported on the mast assembly, one or more operator controls, and a lifting structure having a chain structure for performing a lifting and lowering of the load handling structure relative to the mast assembly. The materials handling vehicle further comprises a height sensor for generating a height signal corresponding to vertical movement of the load handling structure relative to the mast assembly, and a vehicle control module for processing the height signal received from the height sensor and an operator control signal received from the one or more operator controls. The vehicle control module evaluates the height signal and the operator control signal and disables one or more vehicle functions if the height signal does not correspond to the operator control signal.

The one or more vehicle functions may include at least one of lowering movement of the load handling structure or vehicle travel movement.

The vehicle control module may disable the one or more vehicle functions if the operator control signal comprises a load handling structure lower signal, and the height signal comprises one of a lifting state signal, corresponding to a height of the load handling structure increasing relative to an adjacent mast section, or a static state signal, corresponding to the height of the load handling structure not changing relative to the adjacent mast section.

The operator control signal may comprise one of a load handling structure lower signal, or a load handling structure lift signal.

The height signal may comprise one of a lowering state signal, corresponding to a height of the load handling structure decreasing relative to an adjacent mast section, a lifting state signal, corresponding to the height of the load handling structure increasing relative to the adjacent mast section, or a static state signal, corresponding to the height of the load handling structure not changing relative to the adjacent mast section. The lifting state and static state signals may comprise signals that do not correspond to the load handling structure lower signal for disabling the one or more vehicle functions.

The materials handling vehicle may further comprise a hydraulic system for actuating the chain structure, and a pressure sensor in the hydraulic system. The vehicle control module may process and evaluate a pressure signal from the pressure sensor indicative of a pressure present in the hydraulic system, and may disable the one or more vehicle functions if the pressure signal indicates the pressure in the hydraulic system is less than a predetermined pressure value.

The one or more vehicle functions may include at least one of lowering movement of the load handling structure or vehicle travel movement.

The height sensor may comprise a height encoder to sense a position of the load handling structure relative to an adjacent mast section.

The materials handling vehicle may further comprise an operator's compartment.

In accordance with another aspect of the invention, a materials handling vehicle is provided having chain slack detection. The materials handling vehicle comprises a mast assembly, a load handling structure supported on the mast assembly, one or more operator controls, a lifting structure having a chain structure for performing a lifting and lowering of the load handling structure relative to the mast assembly, a first sensor for sensing a first operating condition of the lifting structure, a second sensor for sensing a second operating condition of the lifting structure, and a vehicle control module for processing a first signal received from the first sensor and a second signal received from the second sensor. The vehicle control module disables one or more vehicle functions if at least one of: the first signal has a value that corresponds to a chain slack condition in the lifting structure, or the second signal has a value that corresponds to a chain slack condition in the lifting structure.

One of the first and second sensors may comprise a height sensor providing a height signal corresponding to a movement of the load handling structure relative to an adjacent mast section.

The vehicle control module may process an operator control signal received from the one or more operator controls, and the operator control signal may comprise one of a load handling structure lower signal or a load handling structure lift signal.

The one or more vehicle functions may include at least one of lowering movement of the load handling structure or vehicle travel movement. The vehicle control module may disable the one or more vehicle functions if the operator control outputs the load handling structure lower signal, and the height signal corresponds to at least one of a height of the load handling structure increasing relative to the adjacent mast section or the height of the load handling structure not changing relative to the adjacent mast section.

The height sensor may comprise an encoder mounted to the load handling structure.

One of the first and second sensors may comprise at least one pressure sensor located in a hydraulic system for actuating the chain structure. The vehicle control module may process and evaluate a pressure signal from the pressure sensor indicative of pressure present in the hydraulic system, and may disable the one or more vehicle functions if the pressure signal indicates the pressure in the hydraulic system is less than a predetermined pressure value.

In accordance with a further aspect of the invention, a method of detecting a chain slack condition in a materials handling vehicle is provided, the materials handling vehicle having a mast assembly, a load handling structure supported on the mast assembly, one or more operator controls, a lifting structure for performing lifting and lowering of the load handling structure relative to the mast assembly, and a vehicle control module. The method comprises detecting an operator control signal from the one or more operator controls, detecting a height signal corresponding to vertical movement of the load handling structure relative to the mast assembly, receiving and evaluating the operator control signal and the height signal in the vehicle control module, and disabling one or more vehicle functions if the height signal does not correspond to the operator control signal, indicating a chain slack condition.

The one or more vehicle functions may include at least one of lowering movement of a load handling structure or vehicle travel movement.

The operator control signal may comprise one of a load handling structure lower signal, or a load handling structure lift signal. The height signal may comprise one of a lowering state signal, corresponding to a height of the load handling structure decreasing relative to an adjacent mast section, a lifting state signal, corresponding to the height of the load handling structure increasing relative to the adjacent mast section, or a static state signal, corresponding to the height of the load handling structure not changing relative to the adjacent mast section.

The lifting state and static state signals may comprise signals that do not correspond to the load handling structure lower signal for indicating the chain slack condition.

The method of detecting a chain slack condition may further comprise detecting a pressure signal from a pressure sensor in a hydraulic system, wherein the vehicle control module may process and evaluate the pressure signal and may disable the one or more vehicle functions if the pressure signal indicates a pressure in the hydraulic system is less than a predetermined pressure value.

The method of detecting a chain slack condition may further comprise detecting a mast switch signal from a mast switch, wherein the vehicle control module may process and evaluate the mast switch signal and may deactivate detection of a chain slack condition if the mast switch signal indicates that the load handling structure is in a predetermined lowered position.

In accordance with a further aspect of the invention, a method of detecting a chain slack condition in a materials handling vehicle is provided, the materials handling vehicle having a mast assembly, a load handling structure supported on the mast assembly, one or more operator controls, a lifting structure for performing lifting and lowering of the load handling structure relative to the mast assembly, and a vehicle control module. The method comprises detecting, at a first sensor, a first operating condition of the lifting structure, detecting, at a second sensor, a second operating condition of the lifting structure, receiving and evaluating, in the vehicle control module, a first signal corresponding to the first operating condition and a second signal corresponding to the second operating condition, and disabling one or more vehicle functions if at least one of: the first signal has a value that corresponds to a chain slack condition in the lifting structure, or the second signal has a value that corresponds to a chain slack condition in the lifting structure.

The first signal may comprise a height signal and the second signal may comprise a pressure signal.

The one or more vehicle functions may include at least one of lowering movement of the load handling structure or vehicle travel movement, and the vehicle control module may process an operator control signal from the one or more operator controls. The vehicle control module may disable the one or more vehicle functions if the operator control outputs a load handling structure lower signal, and the height signal corresponds to at least one of a height of the load handling structure increasing relative to an adjacent mast section or the height of the load handling structure not changing relative to the adjacent mast section.

One of the first and second sensors may comprise at least one pressure sensor located in a hydraulic system for actuating a chain structure, and the vehicle control module may process and evaluate the pressure signal indicative of a pressure present in the hydraulic system, and may disable the one or more vehicle functions if the pressure signal indicates the pressure in the hydraulic system is less than a predetermined value.

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
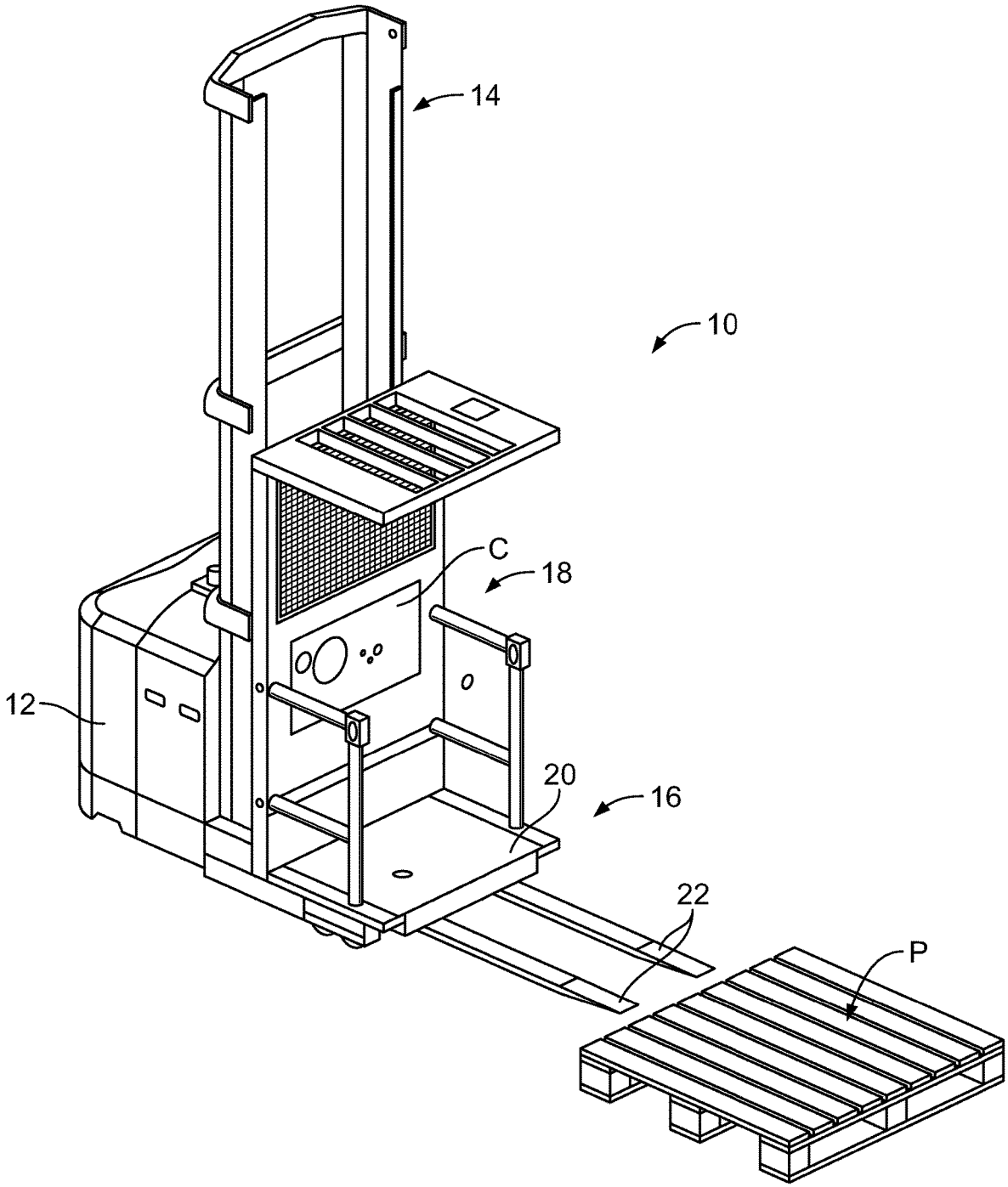
FIG. 1 is a perspective view of a materials handling vehicle including a chain slack detection system according to an aspect of the present invention.

Referring to FIG. 1, a materials handling vehicle 10 is shown for illustrating aspects of a chain slack detection system described herein. The vehicle 10 may include a power unit 12, a mast assembly 14, and a movable carriage comprising a load handling structure 16 located on an opposite side of the mast assembly 14 from the power unit 12. In one embodiment, the load handling structure 16 includes an operator compartment 18 having an operator platform 20, although it is understood that the chain slack detection system described herein may be used with other types of load handling structures. A pair of forks 22 extends outward from a rear edge of the operator platform 20, wherein the forks 22 may be used to support a pallet P, an operator platform (not shown), or other structure for facilitating order picking, load transporting, or other materials handling operations.

Figure 2:
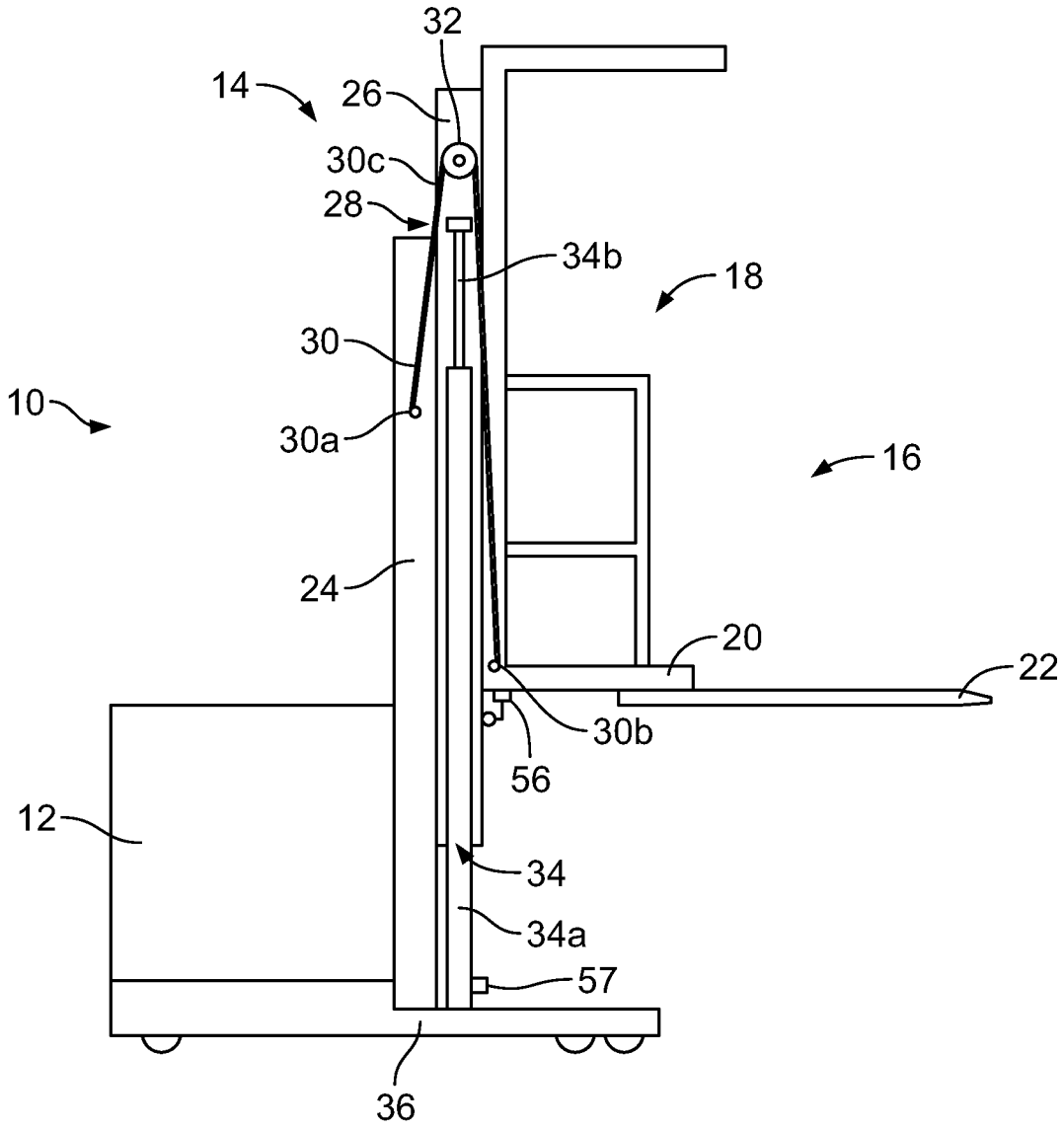
FIG. 2 is a diagrammatic elevational view of the materials handling vehicle shown in FIG. 1 and illustrating load handling structure in a partially elevated position.

Referring to FIGS. 1 and 2, the mast assembly 14 may be supported on the power unit 12, and includes plural telescoping sections forming, for the purposes of the present description, a two stage mast. Specifically, the illustrated mast assembly 14 comprises a stationary first mast section 24 fixed to the power unit 12 and a movable second mast section 26 supported for vertical movement along the first mast section 24, wherein the load handling structure 16 is supported on the second mast section 26. The mast assembly 14 further includes a lifting structure 28 provided for actuating the load handling structure 16 in vertical movement along the adjacent second mast section 26.

As is illustrated in FIG. 2, the illustrated lifting structure 28 comprises a chain structure 30, i.e., one or more chains, having a first end 30*a* attached to the first mast section 24 and an opposing second end 30*b* attached to the operator compartment 18. An intermediate section 30*c* of the chain structure 30 extends over a lift pulley 32 supported on the second mast section 26. The mast assembly 14 additionally includes one or more lift ram/cylinder assemblies 34 for effecting movement of the second mast section 26 and the load handling structure 16 (via the chain structure 30) relative to the first mast section 24. A bottom portion of a cylinder 34*a* of the lift ram/cylinder assembly 34 in the illustrated embodiment is coupled to a frame 36 of the vehicle 10. A ram 34*b* is housed within the cylinder 34*a* and extends from the cylinder 34*a* under the control of pressurized hydraulic fluid, and is fixed to the second mast section 26. Hence, actuation of the ram 34*b* causes the second mast section 26 to move vertically relative to the first mast section 24, and the chain structure 30 actuates the load handling structure 16 to move vertically relative to the second mast section 26 as the chain structure 30 is drawn over the lift pulley 32. It may be understood that for every unit of vertical movement of the second mast section 26, the load handling structure 16 moves twice as far relative to the first mast section 24 via the chain structure 30 and lift pulley 32.

The operator compartment 18 can include operator controls C, see FIG. 1, that may be operated by an operator standing on the operator platform 20 to control, e.g., the speed, steering direction, and braking of the vehicle 10, as well as mast lift and lower operations for selectively effecting vertical movement of the load handling structure 16. For example, the operator controls C may generate an operator control signal OS (see FIG. 5) for controlling hydraulic pressure to the lift ram/cylinder assembly 34, wherein the operator control signal OS may comprise one of a load handling structure lower signal and a load handling structure lift signal. The operator controls C for generating the operator control signal OS may comprise, for example, individual lift/lower buttons, a rocker switch, or any suitable control (not shown in detail).

Figure 3:
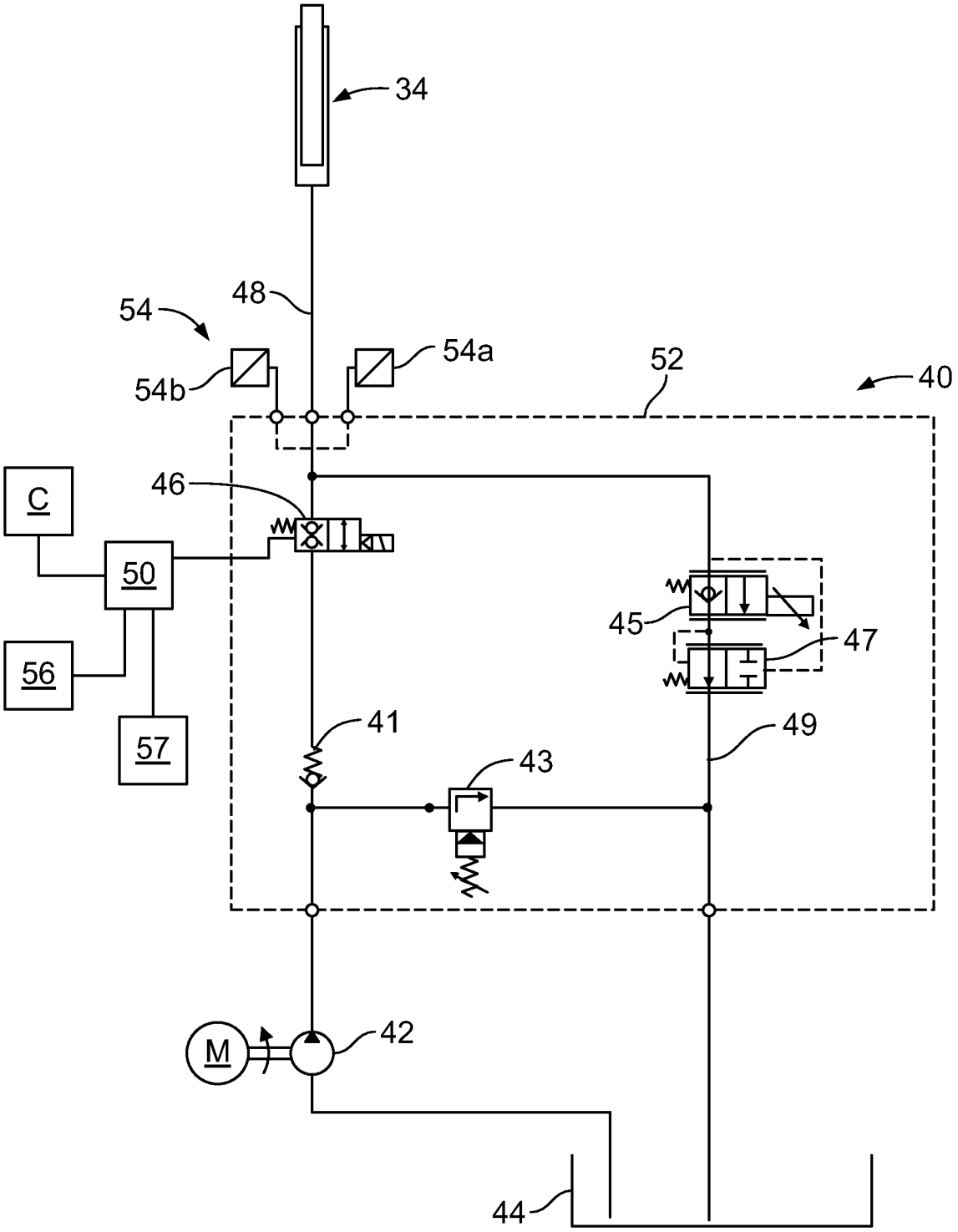
FIG. 3 is a schematic diagram of a hydraulic system for the load handling structure of the materials handling vehicle shown in FIG. 1.

Referring to FIG. 3, an exemplary hydraulic system 40 is illustrated for providing pressurized hydraulic fluid to the lift ram/cylinder assembly 34. The illustrated hydraulic system 40 includes a hydraulic lift pump 42 driven by a pump motor M. The hydraulic lift pump 42 draws hydraulic fluid from a hydraulic fluid reservoir 44 and circulates the hydraulic fluid to the lift ram/cylinder assembly 34 through a solenoid-operated valve 46 and a fluid supply line 48. A check valve 41 may be located in the fluid supply line 48, and a pressure relief valve 43 may be located between the fluid supply line 48 and a fluid return line 49. The solenoid-operated valve 46 can be actuated to selectively control the hydraulic fluid supplied to the lift ram/cylinder assembly 34 for controlling the height of the load handling structure 16. For example, operation of the solenoid-operated valve 46 can be controlled by actuator control signals received from a vehicle control module 50. The actuator control signals can be transmitted to the solenoid-operated valve 46 in response to an operator control signal OS received at the vehicle control module 50 during operation of the operator controls C. A lowering valve 45 located in the fluid return line 49 opens proportional to the operation of the operator controls C, and a pressure compensator 47 can be provided to regulate the flow rate of the lowering valve 45. The solenoid-operated valve 46 may be encompassed in a hydraulic manifold 52, and a pressure sensor 54 is hydraulically connected to the fluid supply line 48 at the hydraulic manifold 52 for sensing a hydraulic pressure of the hydraulic fluid supplied to the lift ram/cylinder assembly 34 and for providing a pressure signal PS (see FIG. 4) to the vehicle control module 50. The pressure sensor 54 may comprise redundant pressure sensors 54*a*, 54*b*, or the pressure sensor 54 may comprise a single pressure sensor, e.g., one of the pressure sensors 54*a*, 54*b* depicted in FIG. 3.

Referring to FIG. 2, the load handling structure 16 includes a height sensor 56 for generating a height signal HS (see FIG. 5) corresponding to vertical movement of the load handling structure 16 relative to a portion of the mast assembly 14, e.g., relative to the second mast section 26, wherein the height signal HS may be provided as an input to the vehicle control module 50. The height signal HS may comprise one of: a lowering state signal, corresponding to the load handling structure height decreasing relative to an adjacent mast section, a lifting state signal, corresponding to the load handling structure height increasing relative to the adjacent mast section, or a static state signal, corresponding to the load handling structure height not changing relative to the adjacent mast section, wherein the adjacent mast section comprises the second mast section 26 in the illustrated embodiment. It may be understood that the static state signal may comprise the absence of a load handling structure lower signal and a load handling lift signal from the height sensor 56, as monitored at the vehicle control module 50.

The height sensor 56 may comprise a height encoder mounted to the load handling structure 16, and, as depicted in FIG. 2, may comprise a rotatory shaft encoder including a wheel that rolls along a portion of the adjacent second mast section 26 to provide a pulse signal to the vehicle control module 50 corresponding to a distance and direction of movement of the load handling structure 16 relative to the second mast section 26. However, it is understood that the system described herein is not limited to a particular form of height sensor for determining movement of the load handling structure 16 relative to the second mast section 26.

In accordance with an aspect of the chain slack detection system, the vehicle control module 50 receives a plurality of sensor signals and command signals from various vehicle components, e.g., operator control signals OS, height signals HS, and pressure signals PS, and can disable one or more vehicle functions based upon an evaluation of one or more of the plurality of signals. For example, the vehicle control module 50 can monitor a mast switch 57, see FIGS. 2 and 3, wherein, if the mast switch 57 is ON, corresponding to the load handling structure 16 being in a lowered position, the vehicle control module 50 will deactivate the chain slack detection associated with the operator control signals OS and height signals HS, see blocks 100 and 102 in FIG. 5. If the mast switch 57 is OFF, indicating that the load handling structure 16 is at or above a predetermined height, e.g., the operator platform 20 is above 200 mm, the operator control signals OS and height signals HS can be used to detect a chain slack condition, see blocks 106, 108, and 110 in FIG. 5. As is described further below, if the pressure signal PS received from the pressure sensor 54 does not correspond to one or more predetermined hydraulic fluid pressures for the hydraulic system 40 or if the height signal HS received from the height sensor 56 does not correspond to the operator control signal OS received from the operator controls C, the vehicle control module 50 can disable one or more vehicle functions. The one or more vehicle functions can include at least one of a lowering movement of the load handling structure 16 and a vehicle travel function comprising forward and/or reverse vehicle travel movement.

Figure 4:
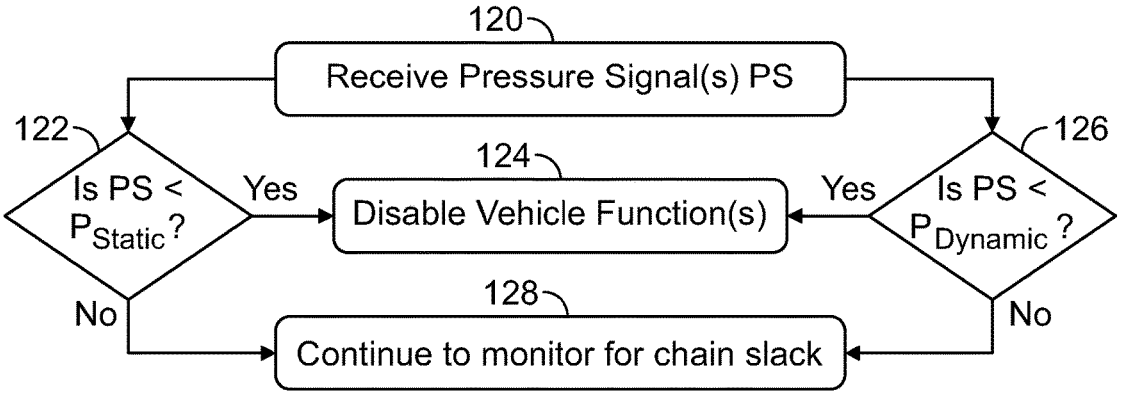
FIG. 4 is a flow diagram illustrating operating states of a first, pressure monitoring system portion of the chain slack detection system.

In a first, pressure monitoring system, illustrated in FIG. 4, the pressure signal PS from the pressure sensor 54 can be monitored, wherein the pressure monitoring system is operable as described herein to disable one or more vehicle functions when the mast switch 57 is in the OFF position, indicating that the load handling structure 16 is in a raised position. The vehicle control module 50 can monitor the pressure signal PS to determine whether the pressure signal PS is below a predetermined value, indicating a condition that could correspond to a chain slack condition, such as may occur if a portion of the load handling structure 16 has become caught in or on a portion of a rack R, see FIG. 6B. For example, a pressure signal PS from the pressure sensor 54 may be received and monitored by the vehicle control module 50, see block 120 in FIG. 4. During a static state condition when the operator control C is not actuated to lower or lift the load handling structure 16, if the pressure signal PS from the pressure sensor 54 is less than a predetermined static pressure $P_{Static}$, as defined for the static state condition, see block 122, the vehicle control module 50 may disable either or both of the load handling structure lower function and the vehicle travel function, see block 124. Further, the pressure signal PS from the pressure sensor 54 may be monitored by the vehicle control module 50 during a dynamic state condition when the operator control C is actuated to lift or lower the load handling structure 16. If the pressure signal PS from the pressure sensor 54 is less than a predetermined dynamic pressure $P_{Dynamic}$, as defined for the dynamic state condition, see block 126, the vehicle control module 50 may disable either or both of the load handling structure lower function and the vehicle travel function, see block 124. The predetermined static and dynamic pressures $P_{Static}$, $P_{Dynamic}$ may be minimum pressures determined with reference to an unloaded or empty, e.g., without an operator, load handling structure 16.

It should be noted that when the load handling structure lower function is disabled, operation of the lift ram/cylinder assembly 34 in the lifting direction, i.e., a load handling structure lift function, can be maintained such that the lift ram/cylinder assembly 34 can be operated to remove any slack and re-establish tension in the chain structure 30. Once the slack in the chain structure 30 is removed, the vehicle control module 50 may reactivate the disabled vehicle functions including, for example, the load handling lower function and the drive function. If the pressure signal PS from the pressure sensor 54 indicates that the hydraulic fluid pressure in the hydraulic system 40 meets the above-described conditions for the static and dynamic pressures $P_{Static}$, $P_{Dynamic}$, then the vehicle control module 50 continues to enable the load handling lower function and the vehicle travel function, and further monitors the height signals HS and the operator control signals OS for first and second chain slack conditions, as is further described below, see block 128.

Figure 5:
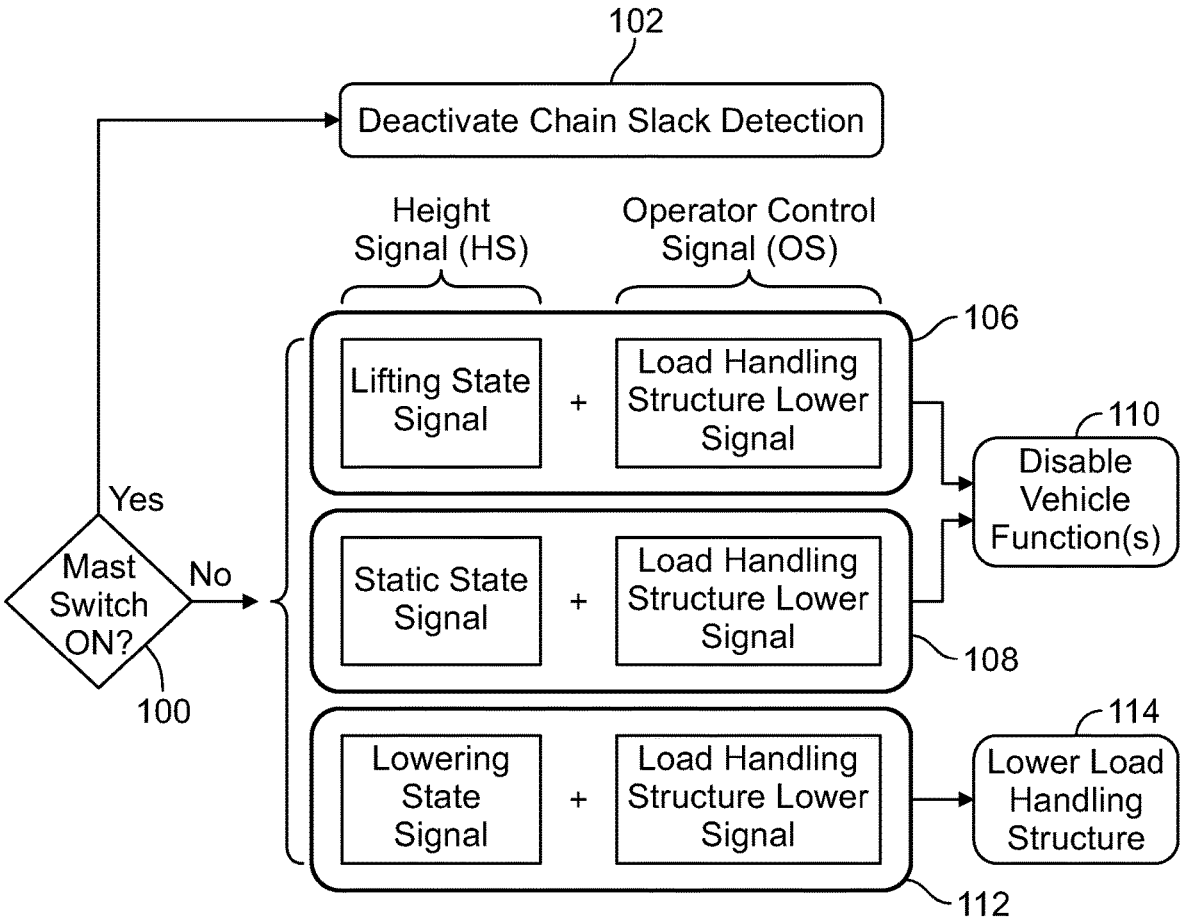
FIG. 5 is a block diagram illustrating operating states of a second, height monitoring system portion of the chain slack detection system.
Figure 6A:
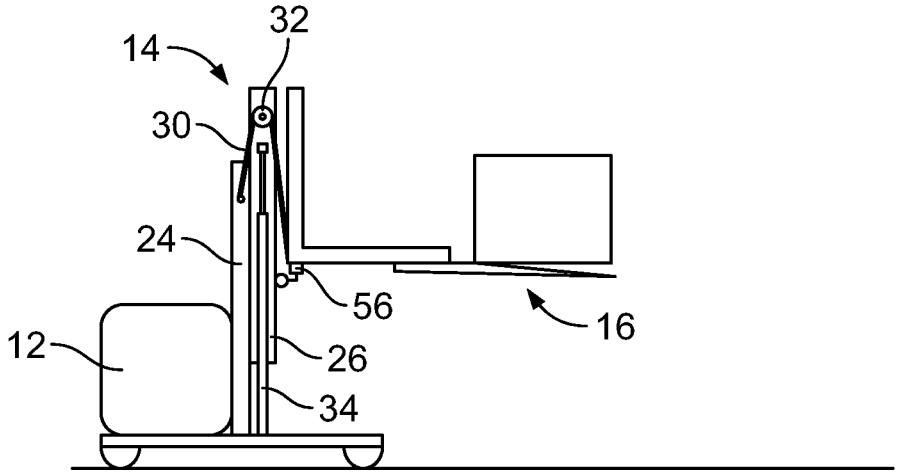
FIG. 6A is a diagrammatic elevational view illustrating a normal load handling structure lowering operation maintaining tension on a chain structure.

In a second, height monitoring system, see FIG. 5, the height signals HS and operator control signals OS can be monitored by the vehicle control module 50 to detect a condition corresponding to chain slack. During a normal lift/lower operation, using one of the operator controls C, the operator can initiate a lowering of the load handling structure 16, providing a load handling structure lower signal to the vehicle control module 50 such that the vehicle control module 50 recognizes that the load handling structure 16 should be lowering relative to the adjacent mast section. When the load handling structure lower signal is initiated, the vehicle control module 50 provides an actuation signal to the solenoid-operated valve 46, see FIG. 3, actuating the lift ram/cylinder assembly 34 such that the second mast section 26 of the mast assembly 14 moves down at a selected first rate, and the load handling structure 16 moves down at a predetermined second rate that is faster than the first rate, e.g., at twice the first rate relative to the first mast section 24 via the chain structure 30 and lift pulley 32. As long as the load handling structure 16 moves down at the predetermined rate relative to the lowering rate of the adjacent second mast section 26, the chain structure 30 is maintained in a taunt, non-slack state during lowering of the load handling structure 16, see FIG. 6A. The height signal HS output from the height sensor 56 comprises a lowering state signal corresponding to the operator control signal OS, i.e., corresponding to a load handling structure lower signal from the operator controls C, and the vehicle control module 50 allows the vehicle function, i.e., lowering of the load handling structure 16, to continue without interruption, see blocks 112 and 114 in FIG. 5.

Figure 6B:
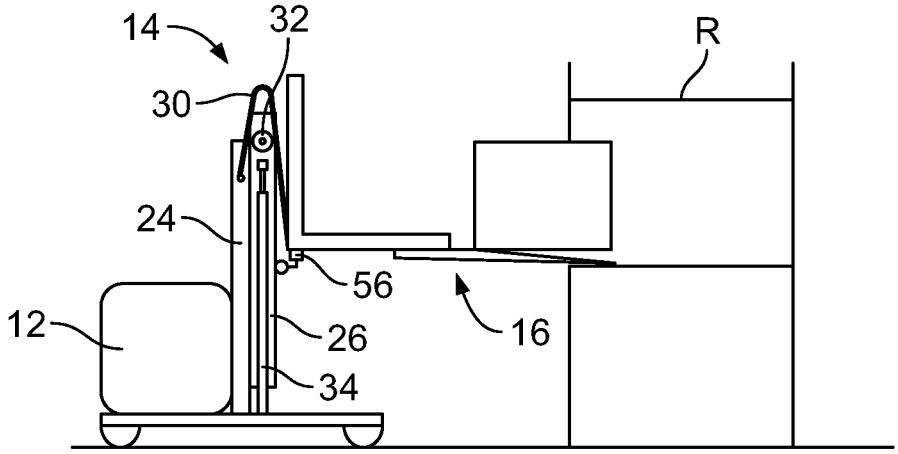
FIG. 6B is a diagrammatic elevational view illustrating a first chain slack condition during a load handling structure lowering operation.

Referring to FIGS. 5 and 6B, in a first chain slack condition, when the operator has initiated the load handling structure lower signal via an input at the operator controls C, a portion of the load handling structure 16 may become caught in or on a portion of a rack R, such as during an order picking operation adjacent to the rack R, preventing the load handling structure 16 from lowering. When the load handling structure 16 is prevented from lowering, this can cause slack in the chain structure 30 as a result of the lift ram/cylinder assembly 34 and the second mast section 26 lowering at the selected first rate in response to the load handling structure lower signal being initiated via an input at the operator controls C, while the load handling structure 16 remains generally stationary, i.e., the load handling structure 16 fails to lower. The failure of the load handling structure 16 to lower at an appropriate second rate, corresponding to the second mast section 26 lowering at the selected first rate, causes a chain slack condition to occur, as illustrated in FIG. 6B. Left unchecked, the accumulated slack in the chain structure 30 can present a substantial danger to the operator, wherein movement of the vehicle 10 away from the rack R while the chain structure 30 is in a slack condition can cause the load handling structure 16 supporting the operator to free-fall when the load handling structure 16 separates from engagement with the rack R. Hence, it is beneficial for such a chain slack condition to be identified and to implement a vehicle control to prevent such free-fall from occurring.

In the above-described first chain slack condition, the relative movement between the load handling structure 16 and the second mast section 26 causes the height sensor 56 to produce a height signal HS corresponding to upward movement of the load handling structure 16. In particular, in response to the load handling structure lower signal, the second mast section 26 moves downward relative to the load handling structure 16, causing the height sensor 56 to provide an apparent indication of upward movement of the load handling structure 16, see block 106 in FIG. 5. The height signal HS provided to the vehicle control module 50 is evaluated by the vehicle control module 50 to determine whether the height signal HS corresponds to the operator control signal OS. The vehicle control module 50 evaluates the received height signal HS, which in the present case comprises a lifting state signal, with reference to the received operator control signal OS comprising a load handling structure lower signal and determines that the operator control signal OS does not correspond to the height signal HS, and disables the one or more vehicle functions, see block 110 in FIG. 5. In particular, disabling of the vehicle functions can comprise disabling actuation of the lift ram/cylinder assembly 34 in the lowering direction to prevent further formation of chain slack and/or disabling the driving function of the vehicle 10 to prevent the vehicle 10 from moving the load handling structure 16 out of supporting engagement with the rack R. It should be noted that operation of the lift ram/cylinder assembly 34 in the lifting direction, i.e., the load handling structure lift function, can be maintained such that the lift ram/cylinder assembly 34 can be operated to remove slack and re-establish tension in the chain structure 30. Once the slack in the chain structure 30 is removed, the vehicle control module 50 may reactivate the disabled vehicle functions including, for example, the load handling lower function and the drive function. Thus, the chain slack detection disclosed herein may be used to prevent a free-fall of the load handling structure 16 caused by slack accumulating in the chain structure 30 due to the load handling structure 16 being prevented from vertical movement.

Figure 6C:
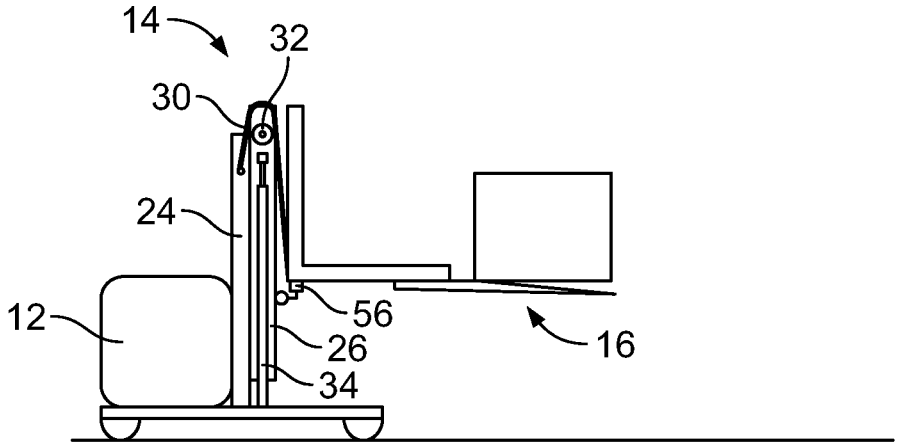
FIG. 6C is a diagrammatic elevational view illustrating a second chain slack condition during a load handling structure lowering operation.

Referring to FIGS. 5 and 6C, in a second chain slack condition, when the operator has initiated the load handling structure lower signal via an input at the operator controls C, a portion of the load handling structure 16 may become stuck or caught on a portion of the adjacent second mast section 26. Similar to the first chain slack condition, when the load handling structure 16 is prevented from lowering at the second rate corresponding to the lowering of the second mast section 26 at the first rate, this can cause slack in the chain structure 30. In particular, a slack condition in the chain structure 30 can occur as a result of both the second mast section 26 and the load handling structure 16 moving downward at the same rate, i.e., the first rate, as illustrated in FIG. 6C. As with the first chain slack condition, left unchecked, the accumulated slack in the chain structure 30 can present a substantial danger to the operator. Specifically, release of the load handling structure 16 from its stuck position in relation to the second mast section 26, while the chain structure 30 is in a slack condition, can cause the load handling structure 16 supporting the operator to free-fall. Hence, it is beneficial for such a chain slack condition to be identified and to implement a vehicle control to prevent such free-fall from occurring.

In the above-described second chain slack condition, in response to the load handling structure lower signal, the second mast section 26 and the load handling structure 16 are maintained at the same relative position as they move downward together. The absence of movement between the load handling structure 16 and the second mast section 26 causes the height sensor 56 to produce a height signal HS corresponding to non-movement of the load handling structure 16, see block 108 in FIG. 5. The vehicle control module 50 receives and evaluates the height signal HS, which in the present case comprises a static state signal, with reference to the received operator control signal OS comprising a load handling structure lower signal, and determines that the operator control signal OS does not correspond to the height signal HS, and disables the one or more vehicle function, see block 110 in FIG. 5. In particular, disabling of the vehicle functions can comprise disabling actuation of the lift ram/cylinder assembly 34 in the lowering direction to prevent further formation of chain slack. Additionally, disabling the vehicle functions can comprise disabling the driving function of the vehicle 10. It should be noted that operation of the lift ram/cylinder assembly 34 in the lifting direction, i.e., the load handling structure lift function, can be maintained such that the lift ram/cylinder assembly 34 can be operated to remove the slack and re-establish tension in the chain structure 30. Once the slack in the chain structure 30 is removed, the vehicle control module 50 may reactivate the disabled vehicle functions including, for example, the load handling lower function and the drive function. Thus, the chain slack detection disclosed herein may be used to prevent a free-fall of the load handling structure 16 caused by slack accumulating in the chain structure 30 due to the load handling structure 16 being stuck relative to the adjacent second mast section 26.

It should be understood that if the pressure signal PS from the pressure sensor 54 indicates that the hydraulic fluid pressure in the hydraulic system 40 meets the above-described conditions for the static and dynamic pressures and, in the absence of a detected chain slack condition, the vehicle control module 50 continues to enable the load handling lower function and the vehicle travel function, and further monitors the height signals HS and the operator control signals OS for the above-described first and second chain slack conditions. It also may be understood that the vehicle control module 50 continues to monitor the pressure signals PS at the same time as monitoring of the height signals HS and the operator control signals OS to control the vehicle functions with reference to determined chain slack conditions during operation of the vehicle 10.

As an alternative to the embodiments discussed above, an embodiment is contemplated wherein the height monitoring system may be operable as soon as the load handling structure 16 raises above a height of 0 mm, and may be operable from the time when the load handling structure 16 is in the lowered position until the load handling structure 16 reaches 200 mm, i.e., the mast switch 57 is OFF, at which point, as discussed above, the pressure monitoring system becomes operable. In this alternative embodiment, the height monitoring system may continue to operate in conjunction with the pressure monitoring system after the mast switch 57 is OFF. As described above, it can be seen that the present chain slack detection system can be implemented with existing hardware, providing sensing of chain slack conditions using inputs from conventionally installed sensors in combination with software implemented logic in the vehicle control module 50. That is, a conventional load handling structure mounted height sensor 56 can be used in combination with operator control signals, along with a hydraulic fluid supply pressure sensor 54, to provide vehicle control module inputs that are processed in accordance with the logic described above for identifying chain slack conditions caused by different chain slack events, without requiring additional sensors specific to chain slack monitoring.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A materials handling vehicle comprising:

a mast assembly;

a load handling structure supported on the mast assembly;

one or more operator controls for controlling vertical movement of the load handling structure;

a lifting structure having a chain structure for performing a lifting and lowering of the load handling structure relative to the mast assembly;

a height sensor for generating a state signal corresponding to the vertical movement of the load handling structure relative to the mast assembly; and a vehicle control module for processing the state signal received from the height sensor and an operator control signal received from the one or more operator controls, wherein:

the vehicle control module evaluates the state signal and the operator control signal and identifies a chain slack condition if the state signal does not correspond to a movement direction designated by the operator control signal; and the vehicle control module disables one or more vehicle functions when a chain slack condition is identified.

2. The materials handling vehicle as set forth in claim 1, wherein the one or more vehicle functions include at least one of lowering movement of the load handling structure or vehicle travel movement.

3. The materials handling vehicle as set forth in claim 1, wherein the vehicle control module disables the one or more vehicle functions if:

the operator control signal comprises a load handling structure lower signal; and the state signal comprises one of a lifting state signal, corresponding to a height of the load handling structure increasing relative to an adjacent mast section, or a static state signal, corresponding to the height of the load handling structure not changing relative to the adjacent mast section.

4. The materials handling vehicle as set forth in claim 1, wherein the operator control signal comprises one of a load handling structure lower signal, or a load handling structure lift signal.

5. The materials handling vehicle as set forth in claim 4, wherein the state signal comprises one of:

a lowering state signal, corresponding to a height of the load handling structure decreasing relative to an adjacent mast section;

a lifting state signal, corresponding to the height of the load handling structure increasing relative to the adjacent mast section; or a static state signal, corresponding to the height of the load handling structure not changing relative to the adjacent mast section;

wherein the lifting state and static state signals comprise signals that do not correspond to the load handling structure lower signal for disabling the one or more vehicle functions.

6. The materials handling vehicle as set forth in claim 1, further comprising:

a hydraulic system for actuating the chain structure; and a pressure sensor in the hydraulic system;

wherein the vehicle control module processes and evaluates a pressure signal from the pressure sensor indicative of a pressure present in the hydraulic system and disables the one or more vehicle functions if the pressure signal indicates the pressure in the hydraulic system is less than a predetermined pressure value.

7. The materials handling vehicle as set forth in claim 6, wherein the one or more vehicle functions include at least one of lowering movement of the load handling structure or vehicle travel movement.

8. The materials handling vehicle as set forth in claim 1, wherein the height sensor comprises a height encoder to sense a position of the load handling structure relative to an adjacent mast section.

9. The materials handling vehicle as set forth in claim 1, wherein the load handling structure comprises an operator's compartment.

10. A method of detecting a chain slack condition in a materials handling vehicle having a mast assembly, a load handling structure supported on the mast assembly, one or more operator controls, a lifting structure for performing lifting and lowering of the load handling structure relative to the mast assembly, and a vehicle control module, the method comprising:

detecting an operator control signal from the one or more operator controls that control vertical movement of the load handling structure;

detecting a state signal corresponding to vertical movement of the load handling structure relative to the mast assembly;

receiving and evaluating the operator control signal and the state signal in the vehicle control module;

identifying a chain slack condition if the state signal does not correspond to a movement direction designated by the operator control signal; and disabling one or more vehicle functions if a chain slack condition is identified.

11. The method as set forth in claim 10, wherein the one or more vehicle functions include at least one of lowering movement of a load handling structure or vehicle travel movement.

12. The method as set forth in claim 11, wherein the operator control signal comprises one of a load handling structure lower signal, or a load handling structure lift signal; and the state signal comprises one of:

a lowering state signal, corresponding to a height of the load handling structure decreasing relative to an adjacent mast section;

a lifting state signal, corresponding to the height of the load handling structure increasing relative to the adjacent mast section; or a static state signal, corresponding to the height of the load handling structure not changing relative to the adjacent mast section.

13. The method as set forth in claim 12, wherein the lifting state and static state signals comprise signals that do not correspond to the load handling structure lower signal for indicating the chain slack condition.

14. The method as set forth in claim 10, further comprising:

detecting a pressure signal from a pressure sensor in a hydraulic system, wherein the vehicle control module processes and evaluates the pressure signal and disables the one or more vehicle functions if the pressure signal indicates a pressure in the hydraulic system is less than a predetermined pressure value.

15. The method as set forth in claim 10, further comprising:

detecting a mast switch signal from a mast switch, wherein the vehicle control module processes and evaluates the mast switch signal and deactivates detection of a chain slack condition if the mast switch signal indicates that the load handling structure is in a predetermined lowered position.

16. The materials handling vehicle as set forth in claim 1, wherein identification of the chain slack condition is done without requiring additional sensors specific to chain slack monitoring.

17. The method as set forth in claim 10, wherein identifying a chain slack condition is done without requiring additional sensors specific to chain slack monitoring.

* * * * *